United States Patent [19]

Uhlmann

[11] Patent Number: 4,918,762

[45] Date of Patent: Apr. 24, 1990

[54] DOUBLE-URINAL FLUSHING APPARATUS AND METHOD FOR AUTOMATIC OPERATION

[75] Inventor: Fritz Uhlmann, Niederwichtrach, Switzerland

[73] Assignee: Bieri Pumpenbau AG, Munsingen, Switzerland

[21] Appl. No.: 273,832

[22] Filed: Nov. 21, 1988

Related U.S. Application Data

[63] Continuation of Ser. No. 168,154, Mar. 15, 1988, Pat. No. 4,815,150.

[30] Foreign Application Priority Data

Mar. 17, 1987 [CH] Switzerland ..... 00997/87

[51] Int. Cl.[5] ..... E03D 13/00

[52] U.S. Cl. ..... 4/303; 4/305; 4/313

[58] Field of Search ..... 4/301-305, 4/661, DIG. 3, 313; 137/392; 364/141, 482; 340/540, 657, 679; 324/438

[56] References Cited

U.S. PATENT DOCUMENTS

| | | | |
|---|---|---|---|
| 2,060,849 | 11/1936 | Bullard | 340/657 |
| 2,283,525 | 5/1942 | Witham | 340/540 |
| 2,395,150 | 2/1946 | Sloan et al. | 4/303 |
| 2,590,147 | 3/1952 | Bellamy | 4/303 |
| 2,609,419 | 9/1952 | Blair | 340/657 |
| 3,060,416 | 10/1962 | Brown | 340/540 |
| 3,416,162 | 12/1968 | Hamblen | 4/305 |
| 3,751,736 | 8/1973 | Egli | 4/305 |
| 3,908,204 | 9/1975 | Hopkins | 4/DIG. 3 |
| 4,195,374 | 4/1980 | Morris et al. | 4/302 |

*Primary Examiner*—Henry J. Recla
*Assistant Examiner*—Casey Jacyna
*Attorney, Agent, or Firm*—Pearne, Gordon, McCoy & Granger

[57] ABSTRACT

The conductivity of the flushing water in the two siphons is measured by means of two electrodes (16, 17, 18, 19) in each siphon. Whenever the conductivity exceeds a predetermined limit, the flushing operation is triggered after a delay time predetermined by an electronic control device. If the two urinals are used at the same time, one of them is blocked by means of an electronic circuit (30) while the other is flushing so that both urinals are prevented from flushing simultaneously. This has the advantage that the same diameter of pipe can be used for the main water supply line as in a single-urinal installation. Whenever the conductivity of the flushing water in the siphon drops below a certain minimum or exceeds a certain maximum after a predetermined number of flushes or a predetermined length of time, flushing is interrupted by means of electronic circuits (28, 29). Such trouble is displayed on the front panel of the control unit by LED's.

4 Claims, 4 Drawing Sheets

DOUBLE-URINAL FLUSHING APPARATUS AND METHOD FOR AUTOMATIC OPERATION

This is a continuation of application Ser. No. 168,154, filed Mar. 15, 1988, which is now U.S. Pat. No. 4,815,150.

This invention relates to lavatory facilities, and more particularly to a method for automatic operation of the flushing apparatus of a double urinal installation of the type having two electrodes disposed in each respective siphon of the installation and connected to an electronic control device for measuring the conductivity of the flushing water in the siphon and a solenoid valve disposed in each supply line for the flushing water. The invention further relates to flushing apparatus for a double urinal installation of the aforementioned type.

Double urinals have been proposed in which flushing is triggered as soon as the conductivity measured in the siphon between two electrodes disposed there exceeds a predetermined value. One drawback of these prior art installations is that when the two urinals are used simultaneously, or almost simultaneously, flushing of both urinals takes place at the same time, at least for part of the total flushing time. As a result, too large a diameter must be used for the main flushing-water supply line.

It is therefore an object of this invention to provide an improved method for automatic operation of the flushing apparatus of a double urinal, as well as flushing apparatus for a double urinal, which do not have these drawbacks so that the same pipe diameter can be used for the main flushing-water supply line as in a single urinal.

Another object of the invention is to provide such a method and apparatus which make it possible for trouble occurring with the conductivity measurement in the siphon to be indicated and for flushing to be shut off.

To this end, in the method according to the present invention, upon commencement of the flushing operation of one urinal of the double-urinal installation, flushing of the other urinal is blocked during the flushing operation, and/or when the conductivity of the flushing water in the siphon is below a first predetermined value and/or exceeds a second predetermined value after a predetermined number of flushes or after a predetermined period of time, the flushing operation is interrupted and simultaneously an out-of-order indication is triggered.

In the flushing apparatus according to the present invention, of the type initially mentioned, the control device comprises first means for the reciprocal blocking of flushing for the two urinals and/or second means for shutting off flushing in case of trouble.

Preferred embodiments of the invention will now be described in detail with reference to the accompanying drawings, in which.

Figure 1:
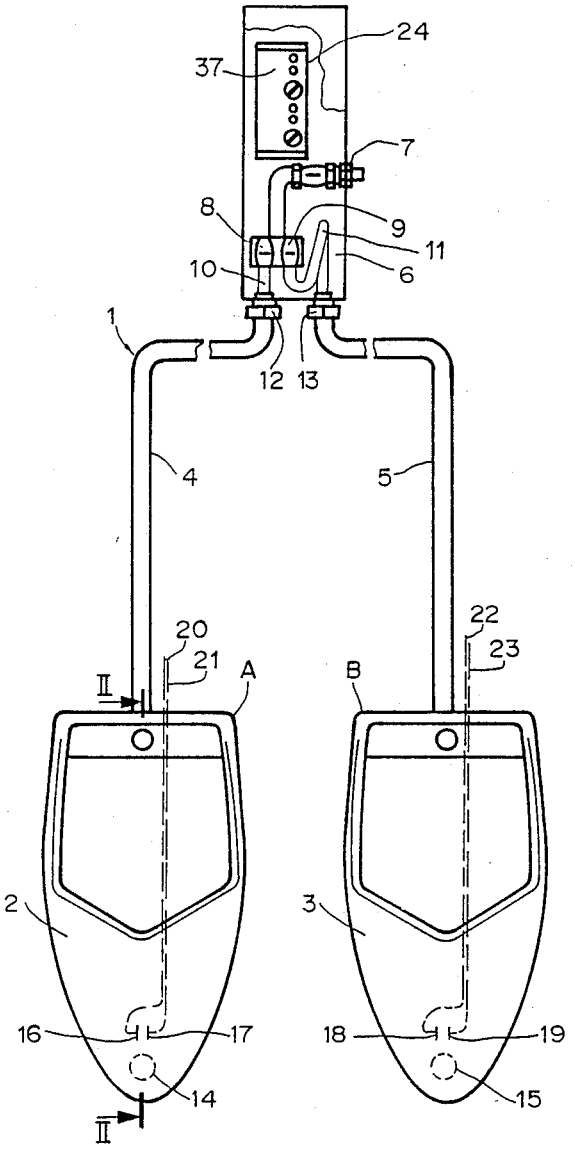
FIG. 1 is an elevation of a double urinal installation.
Figure 3A:
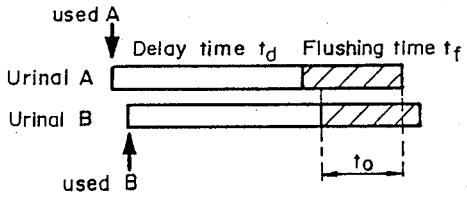
Figure 3B:
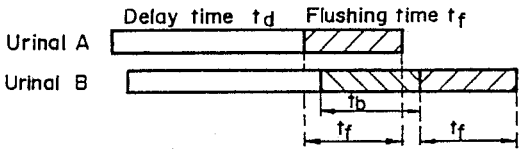
Figure 5:
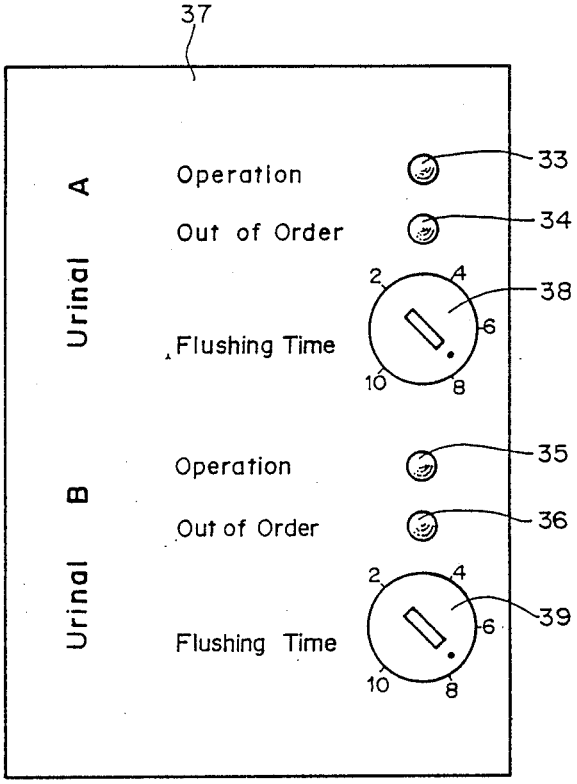
Figure 4:
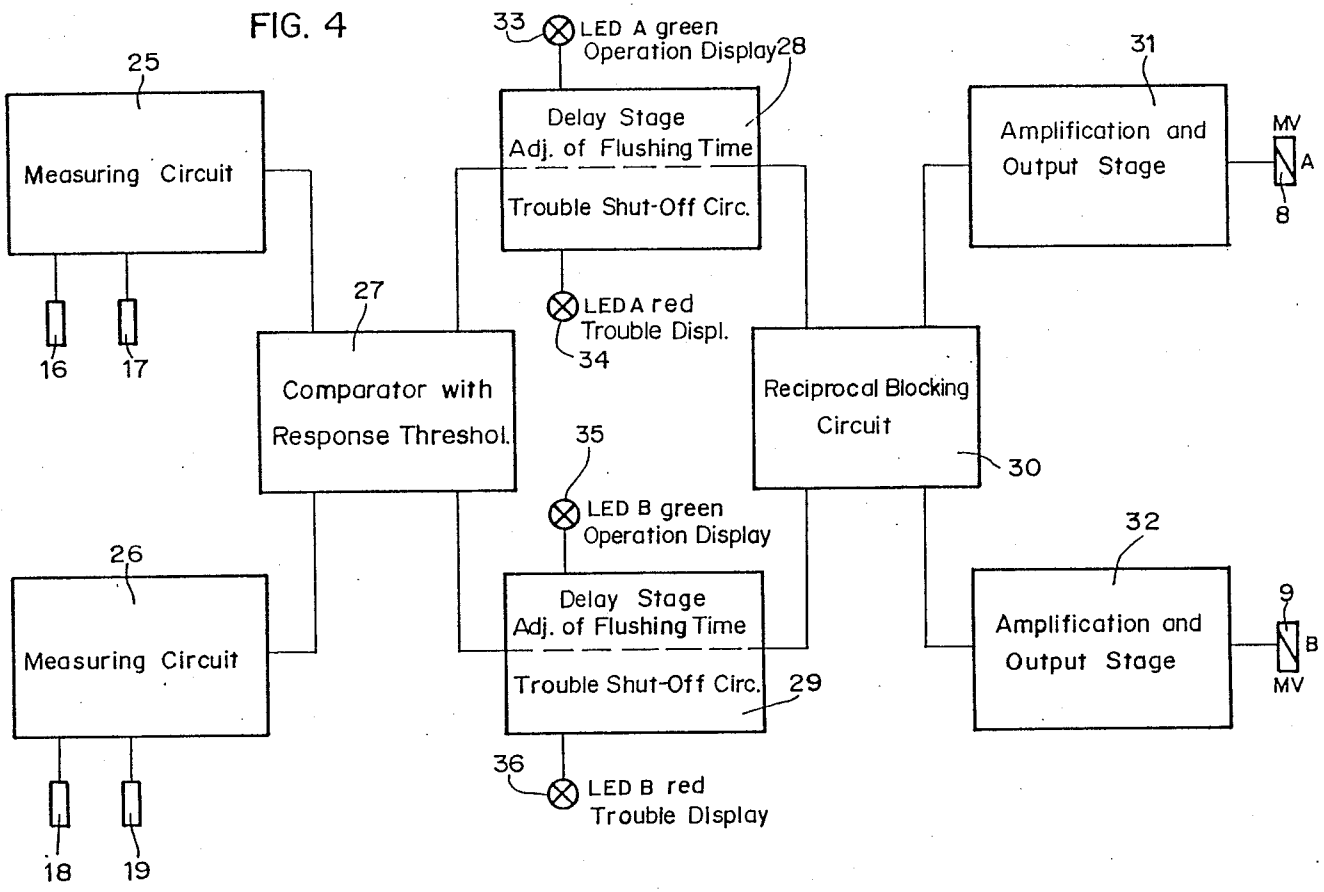
Figure 6:
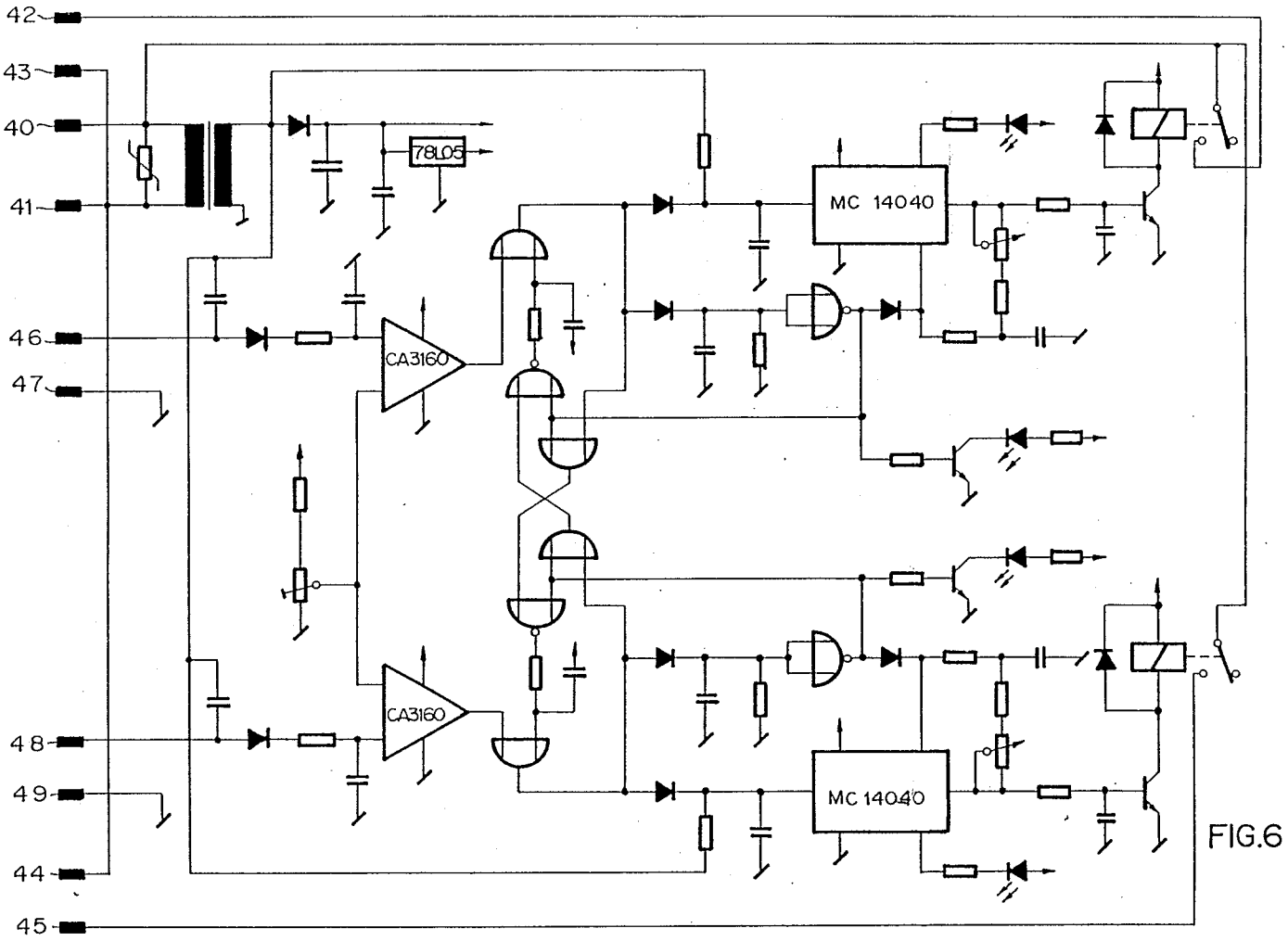

FIGS. 3*a* and 3*b* are graphs showing the disadvantages of the prior art and the advantages of the present invention, respectively, FIG. 4 is a block diagram of the control unit for the installation of FIG. 1, FIG. 5 is an elevation of the front panel of the control unit of FIG. 4, and FIG. 6 is a diagram of the circuitry for the control unit.

Figure 2:
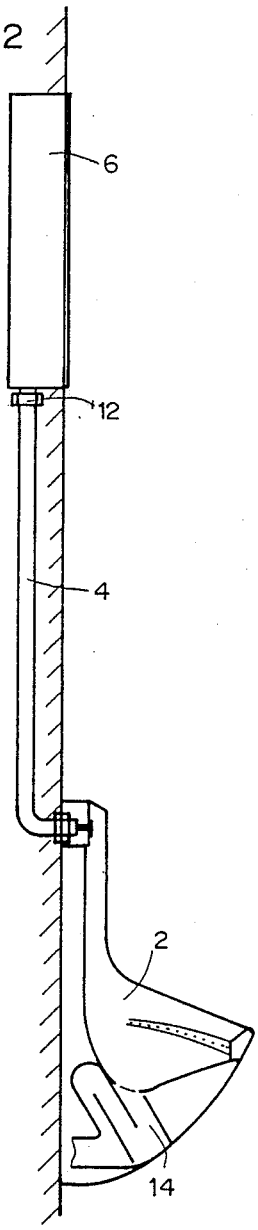
FIG. 2 is a section taken on the line II—II of FIG. 1.

The double urinal installation 1 depicted in FIG. 1 comprises two urinals 2 and 3, secondary supply lines 4 and 5 for the flushing water, and a control unit 6 for controlling flushing of urinals 2 and 3. A main water supply line 7 leads into control unit 6 and to two solenoid valves 8 and 9 provided in unit 6. Two flexible tubes 10 and 11 lead from solenoids 8 and 9 to outside connections 12 and 13 on control unit 6 for secondary supply lines 4 and 5 for the flushing water. In each of the respective siphons 14 and 15 of urinals 2 and 3 there are two electrodes 16, 17 and 18, 19, respectively, for measuring the electrical conductivity of the flushing water in siphons 14 and 15. Electrodes 16, 17 and 18, 19 are connected by electrical leads 20, 21 and 22, 23, respectively, to an electronic control device 24 in control unit 6. FIG. 2 is a section taken on the line II—II of FIG. 1.

When the conductivity between the electrodes in the siphon exceeds a certain predetermined value, i.e., when the impedance between the electrodes drops below a certain level, control device 24 actuates solenoid valve 8 and/or 9 after a certain delay time and initiates the flushing operation.

FIG. 3*a* represents graphically the flushing operation of a prior art double urinal installation. When urinals A and B are used at about the same time, i.e., when the impedance between the pairs of measuring electrodes drops below the response value, the flushing operation is triggered by the electronic controls after a delay time $t_d$ for a flushing time $t_f$, the delay time being the same for both urinals. As a result, flushing overlaps for a certain period of time $t_o$; consequently, the main water supply line must be made with a larger inside diameter, e.g., a $\frac{3}{4}''$ pipe is necessary for simultaneous flushing in a double installation.

FIG. 3*b* shows how flushing operates when urinals A and B are used at about the same time in an installation equipped with the control device of the present invention. Here, too, upon use of urinal A, when control device 24 responds to increased conductivity measured between electrodes 16, 17, the flushing operation is initiated after a delay time $t_d$ for a period of time $t_f$. When urinal B is used, the flushing operation is likewise delayed for a period of time $t_d$ after electrodes 18, 19 respond to an increased conductance measured between them. However, when flushing of urinal A is initiated, the electronic controls block urinal B for a period of time $t_b$, and only after this lapse of time is flushing of urinal B initiated for time $t_f$. Hence the two urinals A and B are never flushed simultaneously, and main water supply line 7 can therefore be equipped with a $\frac{1}{2}''$ pipe. If two double urinal installations are combined into a four-unit installation, a $\frac{3}{4}''$ pipe can be used for the main supply line, whereas normally a 1″ pipe would be needed.

FIG. 4 is a block diagram for the control of the double urinal installation having reciprocal flush-blocking and trouble shut-off. The conductivity in siphons 14 and 15 of the double urinal installation is meausured by means of electrodes 16, 17 and electrodes 18, 19, respectively, which are connected via measuring circuits 25 and 26, respectively, to a comparator 27 having a minimum operating threshold. Comparator 27 is connected to first circuits 28 and 29, each of which contains a delay stage, an adjustment of the flushing time, and a trouble shut-off circuit. First circuits 28 and 29 are connected to a second circuit 30 which brings about reciprocal blocking of urinals A and B when one of them is flushed. Second circuit 30 is connected to amplification and output stages 31 and 32 for operating solenoid valves 8 and 9 of urinals A and B, respectively. Connected to each of components 28 and 29 are respective green LED's 33 and 35 and red LED's 35 and 36. In the non/operative state, green LED's 33 and 35 burn steadily, whereas during the delay or flushing times of urinals A and/or B they flash. In the event of trouble, i.e., if the resistance between electrodes 16, 17 or electrodes 18, 19 in the respective siphons 14 or 15 is persistently less than, say, 200Ω or greater than, say, 10 kΩ, red LED 34 or 36 lights up. A continuously too low resistance may occur if, for instance, a coin drops into the urinal and establishes a contact between the electrodes, or if urine scale accumulates between the electrodes. If the lead from electronic control device 24 to the electrodes is interrupted, the resistance will continuously be too high, i.e., greater than the trouble threshold of 10 kΩ, for example. It would also be conceivable to provide a third LED each, e.g., a yellow one, which would light up in case the resistance was too high or too low. When the resistance between the electrodes is continuously too low, flushing of a urinal is shut off by means of circuit 28 or 29 after a predetermined number of flushing operations, say, five. The user or attendant is then made aware by means of the display means, i.e., in this case the LED's, that the apparatus is out of order. If flushing were not shut off in case of trouble, the water consumption would be too high, for one thing, and for another thing flushing of the other urinal of the double urinal installation would be permanently blocked. Provision might also be made for having electronic control 24 cut off flushing of a urinal after a predetermined period of time whenever trouble occurs, this being indicated in any case by the LED's. It would also be conceivable to have trouble indicated by an acoustic signal.

Electronic control circuit 24 might, for example, be set up with a single-chip processor, and the data relating to the operation—flushing, delay, blocking, or trouble—could then be called up. In this case only one lamp per urinal would be necessary, which would, for example, burn steadily during normal operation, flash twice for insufficient resistance, and flash three times for too high resistance.

FIG. 5 shows the front panel 37 of control device 24. The flushing time for urinals A or B can be set separately, e.g., between 2 and 10 seconds, by means of a setting knob 38.

A circuit diagram of electronic control device 24 is shown in FIG. 6. It comprises two connections 40 and 41 to the mains, connections 42, 43 and 44, 45 for solenoid valves 8 and 9, respectively, connections 46 and 47 for electrodes 16, 17 of urinal A, and connections 48 and 49 for electrodes 18, 19 of urinal B.

The trouble shut-off described above might also be utilized for single-urinal installations.

What is claimed is:

1. In a urinal installation of the type having two urinals connected to two water supply lines connected to a main water supply line, a solenoid valve connected in each of said two water supply lines for flushing said urinals, each urinal having a siphon with two electrodes respectively disposed in each of said siphons, an electronic control device for measuring the conductivity of flushing water in said siphons, electronic control means responsive to said electrodes for activating said solenoid valves for flushing said urinals, wherein the improvement comprises:

said main water supply line being of a size sufficient for flushing a single urinal and, said control means having first means for deactivating one of said solenoid valves when the other is activated for flushing one of said two urinals, whereby said urinals can be flushed using a main water supply line designed for a single urinal.

2. A urinal installation as recited in claim 1, wherein the improvement further comprises:

said control device having second means for shutting off flushing.

3. A urinal installation as recited in claim 2, wherein said control device further includes third means for indicating a disturbance of said flushing apparatus.

4. A urinal installation as recited in claim 2, further comprising means for indicating a disturbance whenever the conductivity between said electrodes is continuously below a first predetermined value or continuously above a second predetermined value.

* * * * *